US009159288B2

(12) United States Patent
Chang et al.

(10) Patent No.: US 9,159,288 B2
(45) Date of Patent: Oct. 13, 2015

(54) GATE LINE DRIVER CIRCUIT FOR DISPLAY ELEMENT ARRAY

(71) Applicant: Apple Inc., Cupertino, CA (US)

(72) Inventors: Shih Chang Chang, Cupertino, CA (US); Young Bae Park, San Jose, CA (US); Chun-Yao Huang, Cupertino, CA (US); Kyung Wook Kim, Cupertino, CA (US); Szu-Hsien Lee, Cupertino, CA (US)

(73) Assignee: Apple Inc., Cupertino, CA (US)

( * ) Notice: Subject to any disclaimer, the term of this patent is extended or adjusted under 35 U.S.C. 154(b) by 256 days.

(21) Appl. No.: 13/661,839

(22) Filed: Oct. 26, 2012

(65) Prior Publication Data

US 2013/0235003 A1 Sep. 12, 2013

Related U.S. Application Data

(60) Provisional application No. 61/609,148, filed on Mar. 9, 2012.

(51) Int. Cl.
*G09G 3/36* (2006.01)

(52) U.S. Cl.
CPC ..... *G09G 3/3677* (2013.01)

(58) Field of Classification Search
CPC ..... G09G 3/3677; G09G 2310/0267
USPC ..... 345/100
See application file for complete search history.

(56) References Cited

U.S. PATENT DOCUMENTS 3,449,682 A * 6/1969 Miwa et al. ..... 330/307
6,426,743 B1 * 7/2002 Yeo et al. ..... 345/213
8,049,706 B2 11/2011 Tsou
8,194,026 B2 6/2012 Lee et al.
2003/0128180 A1 * 7/2003 Kim et al. ..... 345/100
2005/0134545 A1 6/2005 Jang et al.
2006/0279512 A1 * 12/2006 Kim et al. ..... 345/100
2007/0018940 A1 1/2007 Park
2007/0229429 A1 * 10/2007 Yu et al. ..... 345/94
2007/0291982 A1 12/2007 Kim et al.

(Continued)

FOREIGN PATENT DOCUMENTS

WO WO 2011007464 A1 * 1/2011

OTHER PUBLICATIONS

JEDEC definition of floating node downloaded Sep. 8, 2014, from http://www.jedec.org/standards-documents/dictionary/terms/floating-node.*

(Continued)

*Primary Examiner* — Dorothy Harris
(74) *Attorney, Agent, or Firm* — Blakely, Sokoloff, Taylor & Zafman LLP

(57) ABSTRACT

Gate line driver circuitry applies an output pulse to each of several gate lines for a display element array. The circuitry has a number of gate drivers each being coupled to drive a respective one of the gate lines. Each of the gate drivers has an output stage in which a high side transistor and a low side transistor are coupled to drive the respective gate line, responsive to at least one clock signal. A pull down transistor is coupled to discharge a control electrode of the output stage. A control circuit having a cascode amplifier is coupled to drive the pull down transistor as a function of a) at least one clock signal and b) feedback from the control electrode. Other embodiments are also described and claimed.

18 Claims, 5 Drawing Sheets

(56) References Cited

U.S. PATENT DOCUMENTS

| | | | | |
|---|---|---|---|---|
| 2009/0322737 | A1 | 12/2009 | Kim et al. | |
| 2010/0158188 | A1* | 6/2010 | Lee et al. | 377/79 |
| 2010/0182226 | A1* | 7/2010 | Umezaki | 345/98 |
| 2010/0309184 | A1* | 12/2010 | Yamamoto et al. | 345/209 |
| 2011/0157123 | A1 | 6/2011 | Cho | |
| 2011/0199354 | A1* | 8/2011 | Iwase et al. | 345/208 |
| 2011/0274234 | A1* | 11/2011 | Sakamoto et al. | 377/64 |
| 2012/0087460 | A1* | 4/2012 | Moriwaki | 377/64 |
| 2012/0105397 | A1* | 5/2012 | Tan et al. | 345/205 |
| 2012/0121061 | A1* | 5/2012 | Sakamoto et al. | 377/64 |
| 2012/0139883 | A1 | 6/2012 | Lee et al. | |
| 2012/0207266 | A1 | 8/2012 | Tobita et al. | |
| 2012/0249502 | A1 | 10/2012 | Takahashi | |

OTHER PUBLICATIONS

"Bootstrapping (electronics)", Wikipedia, Mar. 8, 2012, Internet at: http://en.wikipedia.org/wiki/Bootstrapping_(electronics), (3 pages)P.

Cristaldi, David J., et al., "Liquid Crystal Display Drivers", Techniques and Circuits, Springer Science+Business Media B.V. 2009, Softcover reprint of hardcover 1st Edition 2009, ISBN 978-481-8482-8, (Table of Contents, pp. vii-x; and pp. 189-235).

* cited by examiner

GATE LINE DRIVER CIRCUIT FOR DISPLAY ELEMENT ARRAY

RELATED MATTERS

This application claims the benefit of the earlier filing date of provisional application No. 61/609,148, filed Mar. 9, 2012, entitled "Gate Line Driver Circuit for Display Element Array".

FIELD

An embodiment of the invention relates to circuitry for driving the gate lines of a display element array, such as an active matrix liquid crystal display (LCD) metal oxide semiconductor (MOS) thin film transistor (TFT) array. Other embodiments are also described.

BACKGROUND

For many applications, and particularly in consumer electronic devices, the large and heavy cathode ray tube (CRT) has been replaced by flat panel display types such as liquid crystal display (LCD), plasma, and organic light emitting diode (OLED). A flat panel display contains an array of display elements. Each display element is to receive a signal that represents the picture element (pixel) value to be displayed at that location. In an active matrix array, the pixel signal is applied using a transistor that is coupled to and integrated with the display element. The transistor acts as a switch element. It has a carrier electrode that receives the pixel signal and a control electrode that receives a gate signal. The gate signal may serve to modulate or turn on or turn off the transistor so as to selectively apply the pixel signal to the coupled display element.

Typically, thousands or millions of copies of the display element and its associated switch element (e.g., an LCD cell and its associated field effect transistor) are reproduced in the form of an array, on a substrate such as a plane of glass or other light transparent material. The array is overlaid with a grid of data lines and gate lines. The data lines serve to deliver the pixel signals to the carrier electrodes of the transistors and the gate lines serve to apply the gate signals to the control electrodes of the transistors. In other words, each of the data lines is coupled to a respective group of display elements, typically referred to as a column of display elements, while each of the gate lines is coupled to a respective row of display elements.

Each data line is coupled to a data line driver circuit that receives control and pixel signals from a signal generator. The latter translates incoming pixel values (for example, red, green and blue pixel values) into data signals (with appropriate timing). The data line driver then performs the needed voltage level shifting to produce a pixel signal with the needed fan-out (current capability).

As to the gate lines, each gate line is coupled to a gate line driver circuit that receives clock (control) signals from the signal generator. These clocks signals, together with a start pulse signal (SP, GSP) are generated into the domain of a reference clock that is received by the signal generator along with horizontal and vertical sync signals for defining the scan of a each frame. Each gate driver circuit typically drives a respective gate line. The array of display elements are, in most cases, driven in a horizontal or line-by-line scanning fashion: the desired pixel signals for a selected row of display elements are provided on the data lines; and the selected row of display elements is "enabled" by a pulse that is asserted on the associated gate line, by the gate driver circuit of that gate line. The approach is to scan line-by-line or row-by-row in a vertical direction, until the entire display element array has been "filled" with the pixel values of a single image frame.

The gate driver circuitry has stringent requirements in terms of timing of the transitions in the gate signals that it generates (and that are applied to the gate lines). Due to the nature of the display element array where an entire row of display elements are activated essentially simultaneously (within a single gate signal pulse window), the gate driver circuitry needs to provide precise control of the transitions in these gate drive signals. Furthermore, the gate driver circuitry should be reliable in that it has to withstand millions of operation cycles. For instance, in a 60 Hz display panel, the array of display elements are refreshed 60 times per second. Combining this with typical continuous operation ranging on the order of several hours, it can be seen that the gate driver circuitry needs to be not just accurate but also reliable. This is especially important when the gate driver circuitry has been integrated with the display element array on the same substrate (referred to sometimes as gate-on-array, GOA). This may result in a fairly expensive display or touch screen of a complex consumer electronic device such as a tablet computer, a laptop computer or a home entertainment system. A further limitation on the gate driver circuitry may be its constituent transistors and the manufacturing process used to produce them, e.g. where only n-channel metal oxide semiconductor field effect transistors (NMOS devices) are allowed in some cases. Finally, manufacturing process variations make it difficult to tightly control the operating characteristics of such transistors, including their threshold voltages, $V_{th}$. The task of designing the gate line driver circuitry thus becomes fairly complex in view of such constraints, where there is a need to ensure that the constituent transistors can be turned on and turned off as designed, so as to meet stringent timing requirements as well as reliability goals.

SUMMARY

Gate line driver circuitry for use with an array of display elements is described, that may be more robust. The gate line driver circuitry generates an output pulse to each of the gate lines, using a gate driver for each gate line. Each gate driver has an output stage in which a high side transistor and a low side transistor are coupled to drive the respective gate line, responsive to at least one of several available clock signals. A pull down transistor is coupled to discharge a control electrode of the output stage. A control circuit is provided that has a cascode amplifier coupled to drive the pull down transistor as a function of a) at least one of the clock signals and b) feedback from the control electrode. This may help better stabilize the voltage on the control electrode of the high side transistor in the output stage.

Other embodiments are also described, including for example one in which the control circuit receives a clear signal (CLR), which may be asserted during a display power down interval or during a display refresh interval (e.g., at the end of each frame interval). The control circuit includes one or more further transistors that receive the CLR signal and, in response to assertion of the CLR signal, force an intermediate node of the cascade amplifier to a known state so that the cascade amplifier in effect becomes decoupled from the pull-down transistor (so long as CLR remains asserted). In one instance, the cascade amplifier includes a first transistor in cascade with a second transistor, where an output or carrier electrode of the latter may be directly connected to a control electrode of the pull down transistor. The CLR signal in that case could be driving a third transistor whose output carrier electrode is coupled to a control electrode of the second transistor, so that when CLR is asserted the second transistor may be placed in essentially cut off mode (or turned off).

The above summary does not include an exhaustive list of all aspects of the present invention. It is contemplated that the invention includes all systems and methods that can be practiced from all suitable combinations of the various aspects summarized above, as well as those disclosed in the Detailed Description below and particularly pointed out in the claims filed with the application. Such combinations have particular advantages not specifically recited in the above summary.

BRIEF DESCRIPTION OF THE DRAWINGS

The embodiments of the invention are illustrated by way of example and not by way of limitation in the figures of the accompanying drawings in which like references indicate similar elements. It should be noted that references to "an" or "one" embodiment of the invention in this disclosure are not necessarily to the same embodiment, and they mean at least one.

DETAILED DESCRIPTION

Several embodiments of the invention with reference to the appended drawings are now explained. Whenever the shapes, relative positions and other aspects of the parts described in the embodiments are not clearly defined, the scope of the invention is not limited only to the parts shown, which are meant merely for the purpose of illustration. Also, while numerous details are set forth, it is understood that some embodiments of the invention may be practiced without these details. In other instances, well-known circuits, structures, and techniques have not been shown in detail so as not to obscure the understanding of this description.

Figure 1:
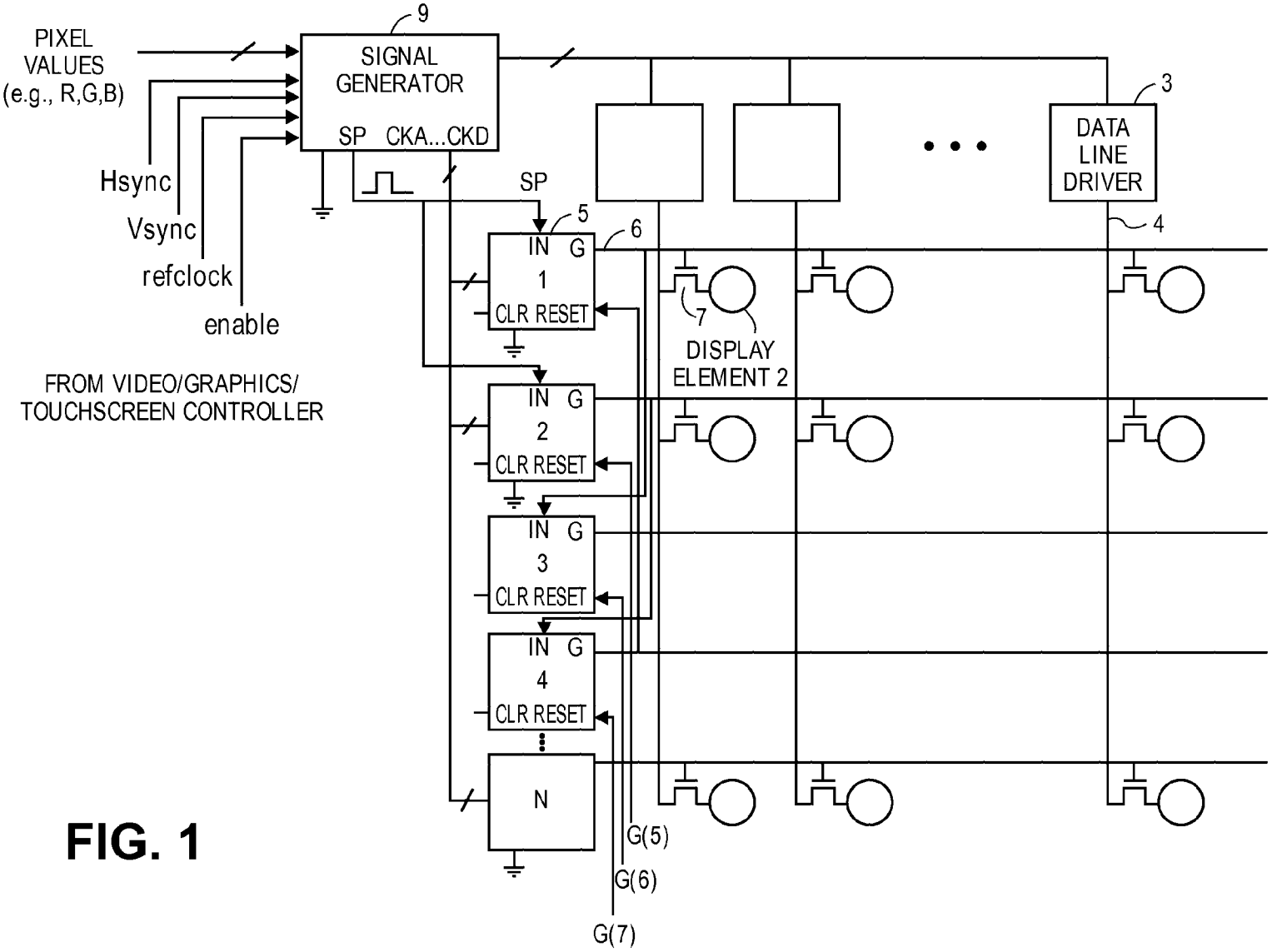
FIG. 1 is a combined block diagram and circuit schematic of a display element array system.

FIG. 1 is a combined block diagram and circuit schematic of an example display element array system, in which an embodiment of the invention may be implemented. The system has an array of display elements 2. Each display element 2 may be an LCD cell, an OLED cell, or other suitable type of display cell that serves to display a digital pixel value at a given position or coordinate (e.g., x, y coordinates). A switch element 7 is coupled to each display element. The switch element 7 may be a field effect transistor as shown, having a gate electrode and upper and lower carrier electrodes (e.g., drain and source electrodes). In this example, the switch element 7 may be a MOS TFT device that is formed on the same transparent substrate as the display element 2. A source of the transistor is coupled to a cell electrode of the display element while its drain is coupled to a drain line 4. Each drain line 4 is coupled in the same manner to a group of such switch elements 7, in this case forming a column. There are several of such columns as shown. The control electrode (e.g., gate) of the switch element 7 is coupled to a gate line 6. The gate line 6 serves to deliver a display element select or control signal to any one of a group of connected switch elements 7. Each gate line 6 is coupled in the same manner to a respective group of switch elements 7, in this case forming a row. There are N such rows as shown. With suitable signals being applied to the gate lines and drain lines, full control of the color and/or light output characteristics of each cell can be achieved.

The system also has gate line driver circuitry that generates, and is coupled to apply, an output pulse G(i) to each of the N gate lines 6. There is a separate gate line driver 5 (also referred to here as gate driver 5) coupled to drive a respective one of the gate lines 6 as shown. In this example, each gate driver 5 receives at least two clock signals, here, four clocks signals CKA, CKB, CKC, and CKD, which are produced by a signal generator 9. A clock signal is a precision generated digital periodic signal, e.g. binary, 50% duty cycle or square wave, whose transitions may be precisely controlled to be in synch with a reference clock (e.g., refclock). Note that the amplitude of a clock signal may be larger than the swing used by general purpose logic gates, particularly in the case of CKA which as explained below may impart a larger amplitude to the output pulse G(i). In one embodiment, each of the clock signals have 50% duty cycle, and their half-period is equal to about twice the duration of a horizontal sync interval H—see FIGS. 5 and 6 for example timing diagrams showing such clocks signals.

The gate driver 5 also has a Carrier-In input (In). This input may receive a start pulse (SP, also referred to here as GSP), when the gate driver 5 is located at the edge of the display element array. There is also a Reset input which as explained below serves to initialize a control electrode of an output stage of the gate driver 5 so as to prepare for the next scan cycle. There may also be an optional CLR input, which receives a pulse that causes the gate driver to turn off (or not drive its gate line). This may be used during a power-off sequence for the display system. Note that some of the inputs to a particular gate driver 5 may be generated by another gate driver 5; for example, the Carrier-In of the third and any subsequent gate driver 5 is fed by the output pulse G of two rows prior, i.e. G(3) is responsive to G(1) at Carrier-In, G(4) is responsive to G(2) at Carrier-In, G(5) is responsive to G(3), etc. Also in this example, G(1) is reset by G(4), G(2) is reset by G(5), G(3) is reset by G(5), etc. Other ways of triggering the output pulse G and resetting the gate driver 5 are possible. The gate drivers 5 are designed such that as a whole they act like a shift register, sequentially generating and applying an output pulse, gate line by gate line, when triggered by the start pulse SP.

The clock signals and start pulse SP are produced by a signal generator 9 in response to translating or decoding conventional Hsync and Vsync video display timing signals together with a data enable signal that may be received from a video/graphics/touchscreen, vgt, controller (not shown). The signal generator 9 also decodes the incoming pixel values from the vgt controller, into their corresponding voltage or current signals (data signals) for the data line drivers 3, which in turn create the pixel signals to be applied to each display element 2 by its associated switch element 7. The signal generator 9 may use a reference clock (refclock) that may be provided by the vgt controller, to precisely control the timing or signal transitions of the clocks CKA . . . CKD and SP that it produces.

Figure 2:
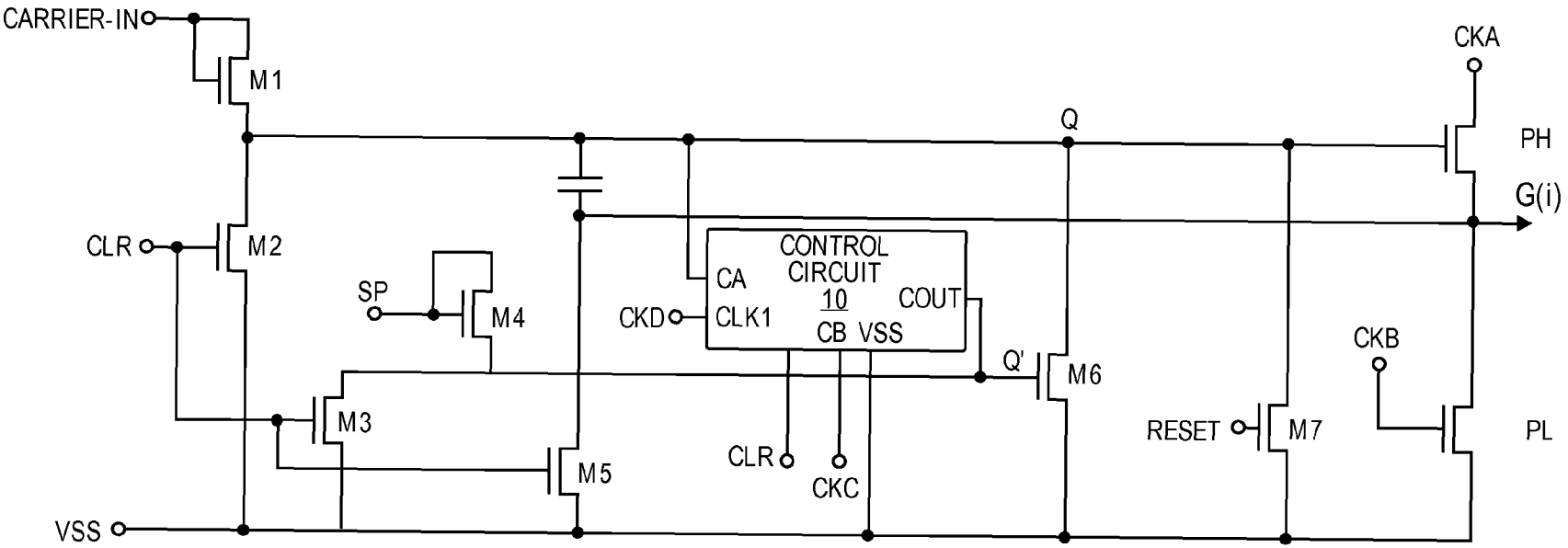
FIG. 2 is an example circuit schematic of a gate driver in accordance with an embodiment of the invention.
Figure 5:
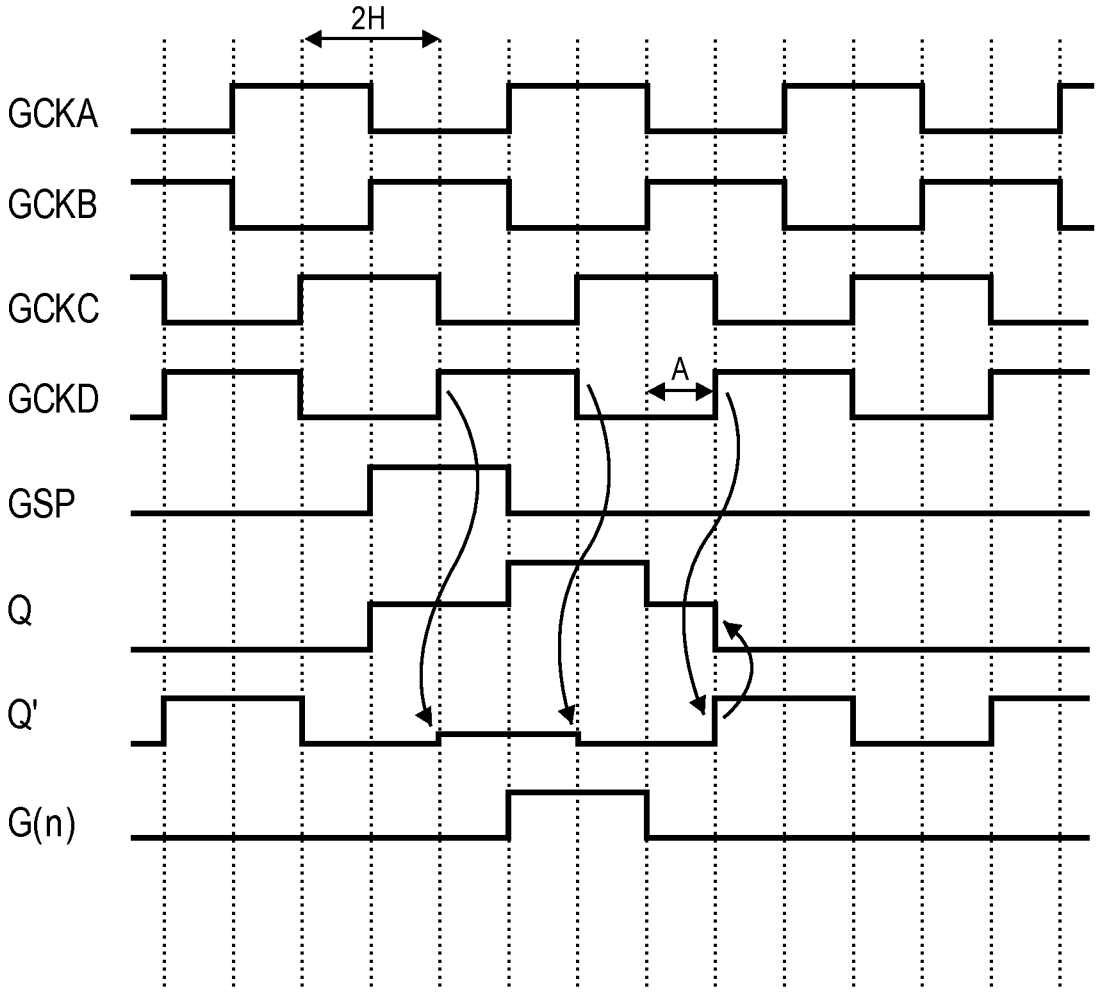
FIG. 5 is a waveform or timing diagram of relevant signals for the gate driver.

FIG. 2 is an example circuit schematic of the gate driver 5 in accordance with an embodiment of the invention. An example timing diagram is shown in FIG. 5, which will be used to describe an operation mode of the date driver 5 further below. Note that in this example, all of the transistors shown are NMOS field effect transistors. This choice has certain advantages relative to a full complementary MOS process in which both NMOS and PMOS transistors are available, namely smaller integrated circuit chip area.

The CLR input is normally deasserted such that transistors M2, M3, and M5 are turned off during normal scanning, and is asserted only when there is to be no scanning of the display element array. An output stage of the gate driver 5 has a high side transistor PH whose source shares a common node with the drain of a low side transistor PL. The source of transistor PL is at a power return node Vss, whereas the drain of the transistor PH receives a clock signal CKA. The gate of the low side transistor PL is controlled by another clock signal CKB, which in this case may be the complement of CKA (180 degrees out of phase).

The high side transistor PH has a control node (gate electrode) Q to which a diode connected transistor M1 is coupled. This allows a carrier signal (Carrier-In) at the In node of the gate driver 5 to charge the node Q to an upper level. In the case where the gate driver 5 is at an edge of the display array, the carrier signal may be the start pulse SP. A pull-down transistor M6 is provided that discharges the node Q, to a predetermined lower level (in this case, Vss), when its gate electrode Q' has been raised to its turn on voltage.

A control circuit 10 is provided whose output Cout is to drive the gate Q' of the pull-down transistor M6, as a function of a) at least two of the clock signals received at its inputs CLK1 and CB, and b) feedback from the control electrode Q through its further input CA. Several options for the control circuit are now described in conjunction with the example timing diagram of FIG. 5.

Referring to FIG. 5, during assertion of Carrier-In (here, GSP, because the gate driver 5 in this example is at the edge of the display), Q is being held at "mid level" or "charged"; now, when GCKD becomes asserted as well, this should not cause Q' to rise too high, because M6 should not turn on at this point, thereby preventing Q from dropping to a low level. Then, when GSP ends, and GCKA is asserted (at about the same time) and then deasserted, this causes G to be pulsed (due to Q being at its charged or mid level) and Q being raised for a high level, as shown. But then Q becomes "floating" during interval A; now, when GCKD is again asserted, there is a need here to bring Q low (so that the next GCKA assertion does not cause G to pulse since GSP is not asserted at this point). A problem here is how to ensure that Q' rises sufficiently high at this point, when GCKD asserts, so that M6 can turn on in order discharge Q (because Q would otherwise remain floating and hence somewhat unpredictable).

Figure 3:
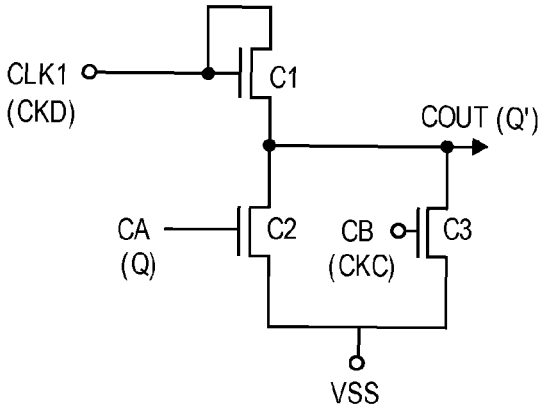
FIG. 3 is a control circuit for driving a pull down transistor for node Q of the gate driver.

FIG. 3 is an example control circuit that tries to but does not adequately alleviate the above problem. Better solutions are presented in FIG. 4*a* and in FIG. 4*b* (discussed further below). Referring first to FIG. 3, output Cout is used to drive the gate Q' of the pull down transistor M6 to a sufficiently high level so that M6 turns on when an incoming clock control at CLK1 is asserted. CLK1 may receive the clock signal CKD (also referred to as GCKD), while CB receives the clock signal CKC or GCKC (which is the complement of CKD). Feedback from the node Q of the high side transistor PH (see FIG. 2) is received through input CA, at the gate of the transistor C2. Note that in one embodiment, all of the constituent transistors here are NMOS devices.

A difficulty with the circuit in FIG. 3 is that its behavior is too sensitive to the ratio of the sizes of transistors C1 and C2; moreover, its ability to consistently raise the voltage at Cout (node Q') in response to GCKD being asserted while GSP is deasserted, is limited. As a result, node Q of the output stage may become unstable, particularly right after output pulse G has been completed. Referring to the timing diagram in FIG. 5, once the output pulse G has been completed, the next assertion of GCKD should bring Q down to its lowest level as shown, by first causing Q' to rise and thereby turn on M6 which then pulls Q down to Vss.

Figure 4A:
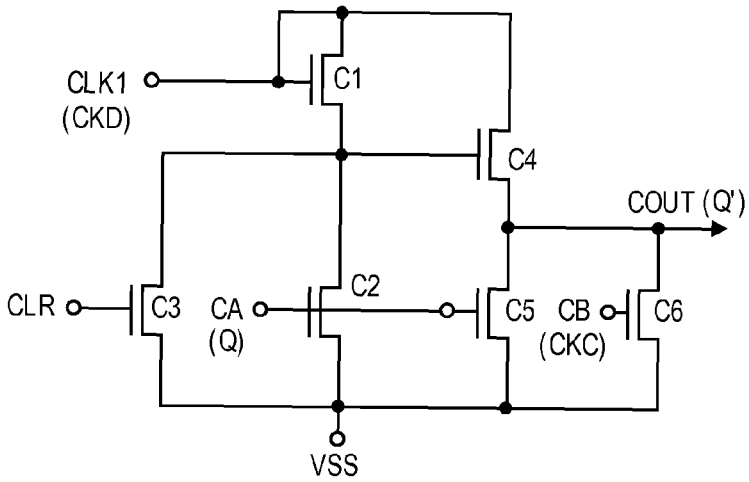
FIG. 4*a* is a control circuit that may stabilize node Q of the gate driver.

FIG. 4*a* shows an example control circuit that may better stabilize the node Q, i.e. more consistently ensure that node Q is pulled down to Vss upon assertion of GCKD, immediately after completion of each output pulse G. This may be achieved using a cascode amplifier that acts like an inverter, namely the combination of upper transistor C4 that is acting as a load on the drain of a lower transistor C5. The lower transistor C5 is coupled to receive feedback from the control electrode Q, at its gate electrode (via input CA), while the upper transistor C4 is coupled to receive one of the clock signals (e.g., GCKD), at its drain. The gate of the latter transistor is coupled to the diode-connected transistor C1, to receive a further clock signal (e.g., GCKD) at the input CLK1. This circuit helps ensure that when Q is high, Q' is low so as to turn off M6 (and thereby keep Q high). To drive Q low, Q' needs to be driven sufficiently high so as to turn on M6. At this point, C5 may be essentially turned off and so Q' may be raised as close to a high limit as possible (available through GCKD and C1).

Figure 4B:
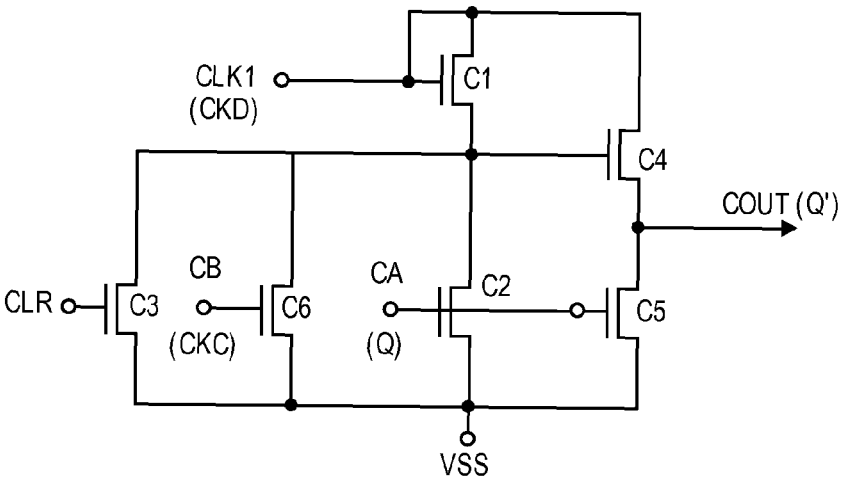
FIG. 4*b* is another control circuit for stabilizing node Q of the gate driver.

FIG. 4*b* is another control circuit for stabilizing node Q. A difference between this circuit and that of FIG. 4*a* is that transistor C6 whose gate is driven by a clock signal at the CB input (e.g., GCKC) has been moved to pull down on the gate of C4 (rather than on the output Cout directly). This circuit may be more effective during a power off sequence (when the display system is powered down or put to sleep), in reducing any charge residue that might remain on the gate electrode of C4.

For both of the embodiments depicted in FIG. 4A and FIG. 4B, the control circuit 10 may be further designed to be decoupled from the control electrode Q' of the M6 (see FIG. 2) under certain circumstances, such as during a display power down interval or during a display refresh interval (e.g., at the end of each frame interval). Recall that the clear signal (CLR) is available, which may be asserted by the signal generator 9 during such circumstances. The control circuit 10 may be fitted with one or more further transistors (e.g., transistor C3) that receive the CLR signal and, in response to assertion of the CLR signal, force an intermediate node of the cascade amplifier to a known state, so that the cascade amplifier in effect becomes decoupled from its output COUT, which is connected to Q' of the pull-down transistor M6. In one instance, as shown, the cascade amplifier includes a first transistor C2 in cascade with a second transistor C4, where an output or carrier electrode of C4 may be directly connected to Q' of the pull down transistor M6 (through node COUT of the control circuit 10). The CLR signal in this case may be routed to drive another transistor C3 whose output carrier electrode is coupled to a control electrode of the second transistor C4, so that when CLR is asserted C3 is turned on, which then pulls the control electrode of C4 down to essentially Vss, thereby placing C4 in essentially cut off mode (turned off).

Figure 6:
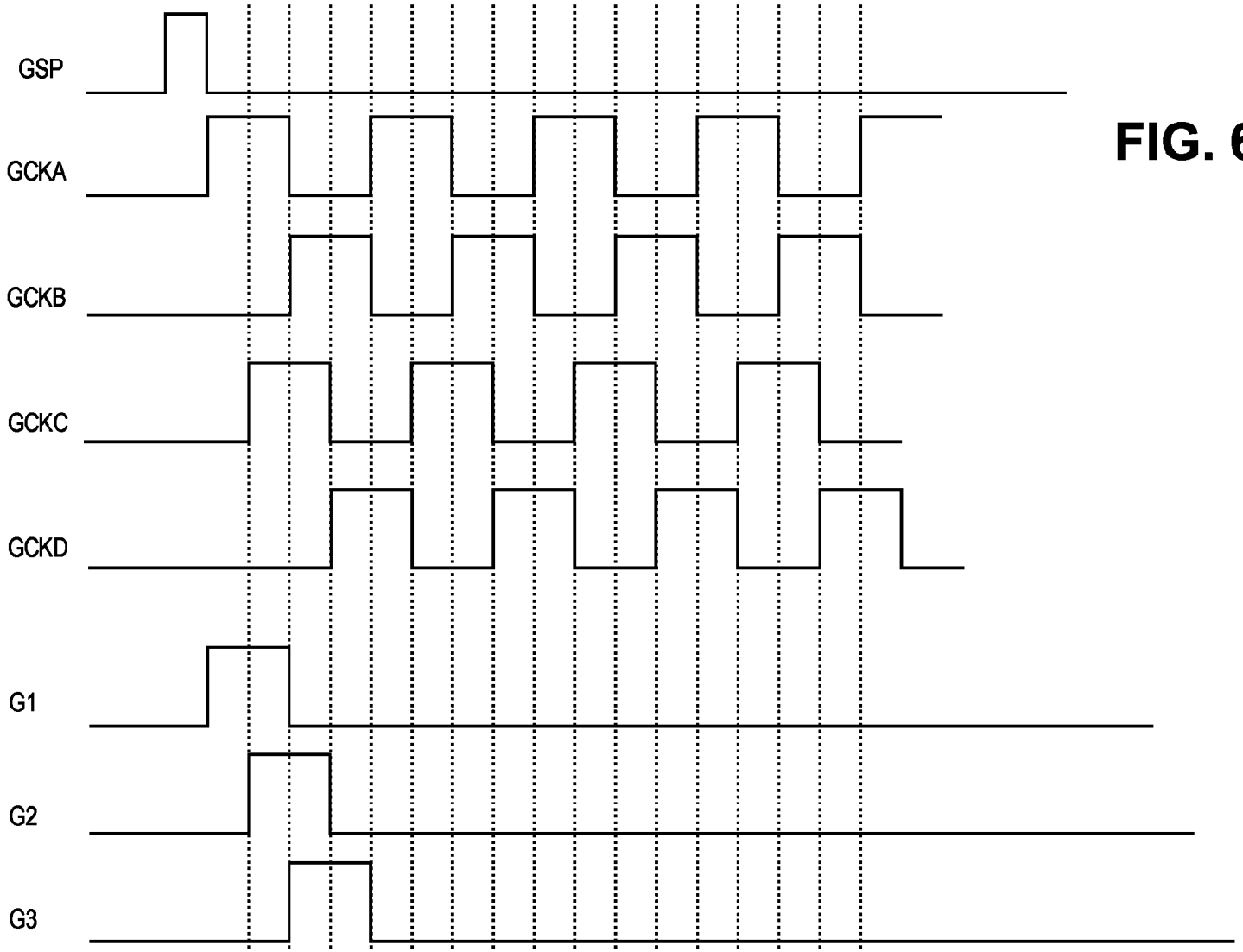
FIG. 6 is a timing diagram showing example overlapping output pulses produced by gate line driver circuitry.

FIG. 6 is another waveform timing diagram that can be produced by the gate driver circuitry of FIG. 1. While the gate driver circuitry in this case still acts like a shift register in that it propagates a start pulse SP sequentially, gate line by gate line, it does so while creating some overlap between two adjacent output pulses $G_i$ and $G_{i+1}$ (that are on adjacent gate lines). Such timing overlap may be achieved by modifying the gate driver circuit of FIG. 2 so as to select others from the available clock signals GCKA-GCKD to drive the transistor PH (see the gate driver circuit schematic in FIG. 2), and routing a different prior (earlier) output pulse G to the Carrier-In input of the gate driver circuit.

While certain embodiments have been described and shown in the accompanying drawings, it is to be understood that such embodiments are merely illustrative of and not restrictive on the broad invention, and that the invention is not limited to the specific constructions and arrangements shown and described, since various other modifications may occur to those of ordinary skill in the art. For example, although the switch element 7 shown in FIG. 1 is an n-channel field effect transistor whose gate is coupled to a gate line and whose drain is coupled to a data line, the gate driver circuitry may also work for driving other types of switch elements, including ones that may have more complex designs such as multiple transistors, or ones with a more simple design such as a single diode. The description is thus to be regarded as illustrative instead of limiting.

What is claimed is:

1. An electronic device comprising:

an array of display elements;

a plurality of gate lines coupled to the display elements;

a plurality of switch elements each being coupled to a respective combination of display element and gate line;

a signal generator to produce a plurality of clock signals; and gate line driver circuitry to apply an output pulse to each of the plurality of gate lines, and having a plurality of gate drivers each being coupled to drive a respective one of the gate lines, each of the gate drivers having an output stage in which a high side transistor and a low side transistor are coupled to drive the respective gate line responsive to at least one of the clock signals, a pull down transistor coupled to discharge a control electrode of the output stage, wherein the output stage control electrode is of the high side transistor, and a control circuit having 1) a lower transistor that is coupled to receive feedback from the control electrode of the output stage, 2) an upper transistor and 3) a diode-connector transistor, wherein a carrier electrode of the upper transistor is a) coupled to receive one of the clock signals and b) coupled to a control electrode of the upper transistor through the diode-connected transistor, and wherein the upper and lower transistors drive a control electrode of the pull down transistor.

2. The device of claim 1 wherein the pull down transistor is to discharge the output stage control electrode to a predetermined level.

3. The device of claim 1 wherein the plurality of clock signals comprise a first clock signal, a second clock signal, a third clock signal, and a fourth clock signal.

4. The device of claim 3 wherein the control circuit comprises a further transistor whose carrier electrode is coupled to drive the pull down transistor as a function of the third clock signal acting upon a control electrode of the further transistor, and the fourth clock signal is acting upon the carrier electrode of the upper transistor, wherein the third and fourth clock signals are complementary to each other.

5. The device of claim 4 wherein the high side transistor and the low side transistor are coupled to drive the respective gate line responsive to the first and second clock signals, respectively, which are complementary to each other.

6. The device of claim 3 wherein the first and second clock signals are complementary to each other, and the third and fourth clock signals are complementary to each other.

7. The device of claim 3 wherein the high side transistor and the low side transistor are coupled to drive the respective gate line responsive to the first and second clock signals, respectively, which are complementary to each other.

8. The device of claim 3 wherein the control circuit comprises:

a further transistor that is coupled to drive the control electrode of the upper transistor responsive to the third clock signal; and an additional transistor coupled to discharge the control electrode of the upper transistor responsive to a clear signal.

9. The device of claim 8 wherein the pull down transistor is to discharge the output stage control electrode to a predetermined level.

10. The device of claim 1 wherein the control circuit further comprises an additional transistor having a control electrode coupled to the output stage control electrode, an upper carrier electrode, and a lower carrier electrode coupled to a power return node, and wherein the control electrode of the upper transistor is coupled to the upper carrier electrode of the additional transistor.

11. The device of claim 10 wherein the control circuit further comprises an additional transistor coupled to discharge the control electrode of the pull down transistor responsive to one of the clock signals.

12. The device of claim 11 wherein the pull down transistor is to discharge the output stage control electrode to a predetermined level.

13. The device of claim 10 wherein the pull down transistor is to discharge the output stage control electrode to a predetermined level.

14. The device of claim 1 wherein the control circuit further comprises an additional transistor coupled to discharge the control electrode of the upper transistor responsive to a clear signal.

15. The device of claim 14 wherein the pull down transistor is to discharge the output stage control electrode to a predetermined level.

16. The device of claim 1 wherein the signal generator is to produce a clear signal that is asserted at the end of an image frame being displayed, when the electronic device is to power down or refresh the array of display elements, and wherein the control circuit comprises a further transistor having an upper carrier electrode coupled to pull down the control electrode of the upper transistor of the control circuit responsive to the clear signal.

17. The electronic device of claim 1 wherein all of the constituent transistors of the output stage, the pull down transistor and the control circuit in the gate driver are N-channel field effect transistors.

18. The device of claim 17 wherein the pull down transistor is to discharge the output stage control electrode to a predetermined level.

* * * * *